United States Patent [19]

Montgomery

[11] Patent Number: 4,801,130

[45] Date of Patent: Jan. 31, 1989

[54] FRAMING TABLE ASSEMBLY

[75] Inventor: Rodney L. Montgomery, Lavista, Nebr.

[73] Assignee: Carlson Systems Corporation, Omaha, Nebr.

[21] Appl. No.: 83,438

[22] Filed: Aug. 10, 1987

[51] Int. Cl.[4] ..... B25B 1/20

[52] U.S. Cl. ..... 269/37; 269/42; 269/43

[58] Field of Search ..... 269/37, 42, 43, 45, 269/58, 110, 216, 217

[56] References Cited

U.S. PATENT DOCUMENTS 4,682,765 7/1987 Mainville ..... 269/43 X

*Primary Examiner*—Steven Mottola

*Attorney, Agent, or Firm*—Geroge R. Nimmer

[57] ABSTRACT

Framing table assembly for manufacturing a wall or other skeletal framework from several parallel riser-members to be accurately perpendicularly attached between two longitudinally extending base-members. The framing table assembly utilizes a pair of longitudinally extending benches for horizontally supporting the respective base-members. Each bench is equipped with a longitudinally extending array of pivotably positioned team-flippers that at a ready-station flanks and that then at a narrowed active-station securely holds respective transversely extending riser-members. After the thusly precisely held riser-members and the base-members are attached into a skeletal framework product, the product can be longitudinally rolled off the benches by virtue of downwardly recessable rollers which are periodically extendable above the bench upper-surface. Among various permissible optional features, the framing table assembly might include powering mechanism for establishing the teamed-flippers narrowed active-station, the usage of pivotably disposed and remotely controllable rollers, etc.

7 Claims, 4 Drawing Sheets

FRAMING TABLE ASSEMBLY

BACKGROUND OF THE INVENTION

Drawing FIGS. 1 and, 2, and 3, are top plan and sectional elevational views, respectively, of a rudimentary embodiment 100 of a prior art framing table assembly. Prior art assembly embodiment 100 comprises a pair of parallel and longitudinally extending benches 10A and 10B, each bench having a horizontal planar upper-surface 11M loftily elevated above factory flooring F and being peripherally rectangularly defined by a longitudinally extending inward-edge 12, a longitudinally extending outward-edge 13, and two shorter transverse-edges (14M, 14N). Benches 10A and 10B are associated in a directionally transverse adjustable relationship; in this regard, a transversely extending channel member 15 rests upon flooring F, is rigidly attached to bench 10A, and pads 16 depending from bench 10B are slidably associated along channel member 15.

Each of the prior art benches 10A and 10B, such as along inward-edges 12, is provided with a plurality of teamed-flippers 99 that are pivotably attached (98) to the bench. Though FIG. 1 depicts four sets of teamed-flippers 99 longitudinally arrayed along each bench, whereby a framework (110) having four riser-members (111) might be accommodated, a greater or lesser number of teamed-flippers might exist to accommodate an appropriate number of riser-members. The pivotal connections 98 shown establish a fixed finite-spacing FS between the two flippers of each teamed-flippers 99. By virtue of such pivotal connections 98 (and as seen in FIGS. 2–3 phantom lines), each teamed-flippers 99 has a pivotably downward inactive-station located below bench upper-surface 11. However, as seen in FIGS. 1–3 solid lines, each teamed-flippers 99 has a pivotably upward ready-station located above the bench upper-surface 11. Thus, teamed-flippers 99 might positionably flank a framework riser-member 111 adjacent to a framework base-member (110A, 110B) whereby the base-member and riser-member components are appropriately positioned for fastening (e.g. stapling, nailing, etc.) into a wall or other skeletal framework product.

Determination of a fixed finite-spacing value FS at each teamed-flippers (99) has presented a vexatious dilemma to prior art workers. If the fixed-spacing value FS is made too great so that an excessive gap G exists between the riser-member (111) and the flanking teamed-flippers (99), reliable positioning of the riser-member with respect to the framework base-member becomes difficult, if not impossible. On the other hand, if the fixed-spacing value FS is reduced so that gap G is at a minimum, this will provide reliably positioning of the framework riser-member but only if the riser-member is substantially free of warpage. But as a practical matter, warpage problems are inherent with lumber and synthetic riser-members, and hence, the prior art is forced to select high values for fixed finite-spacing FS whereby an unsatisfactorily large inherent gap G exists within flanking teamed-flippers (99) and accurate positioning of the riser-members becomes exceedingly difficult.

GENERAL STATEMENT OF THE INVENTION

With the aforementioned general objectives in view, and together with ancillary and specific objectives which will become more apparent as this description proceeds, the framing table assembly of the present invention departs from prior art framing table technologies in that, for each teamed-flippers, there is a powerably establishable third or "active-station" extending above the bench upper-surface and there being between the paired flippers a reduced-spacing less than that for the flippers' transitory ready-station whereby the flanked riser-members, even if warped, can be accurately positioned and securely held for attachment to the framework base-members; the framing table is also equipped with longitudinally extending arrays of rollers having a lower-station located below the bench upper-surface and also having an upper-station extending above the bench upper-surface so that a finally attachably fabricated skeletal framework product might be rolled off the framing table benches; the framing table assembly having structural refinements ancillary to providing the reduced-spacing active-station for the teamed-flippers and the vertical reciprocation for the rollers; and together with other permissible optional features for facilitating implementation of the aforementioned general objectives.

BRIEF DESCRIPTION OF THE DRAWINGS

In the drawing, wherein like characters refer to like parts in the several views, and in which:

FIG. 5 is also a mirror image of a view (not shown) taken along line 5A—5A of FIG. 4.

DETAILED DESCRIPTION OF THE DRAWING

Figure 1:
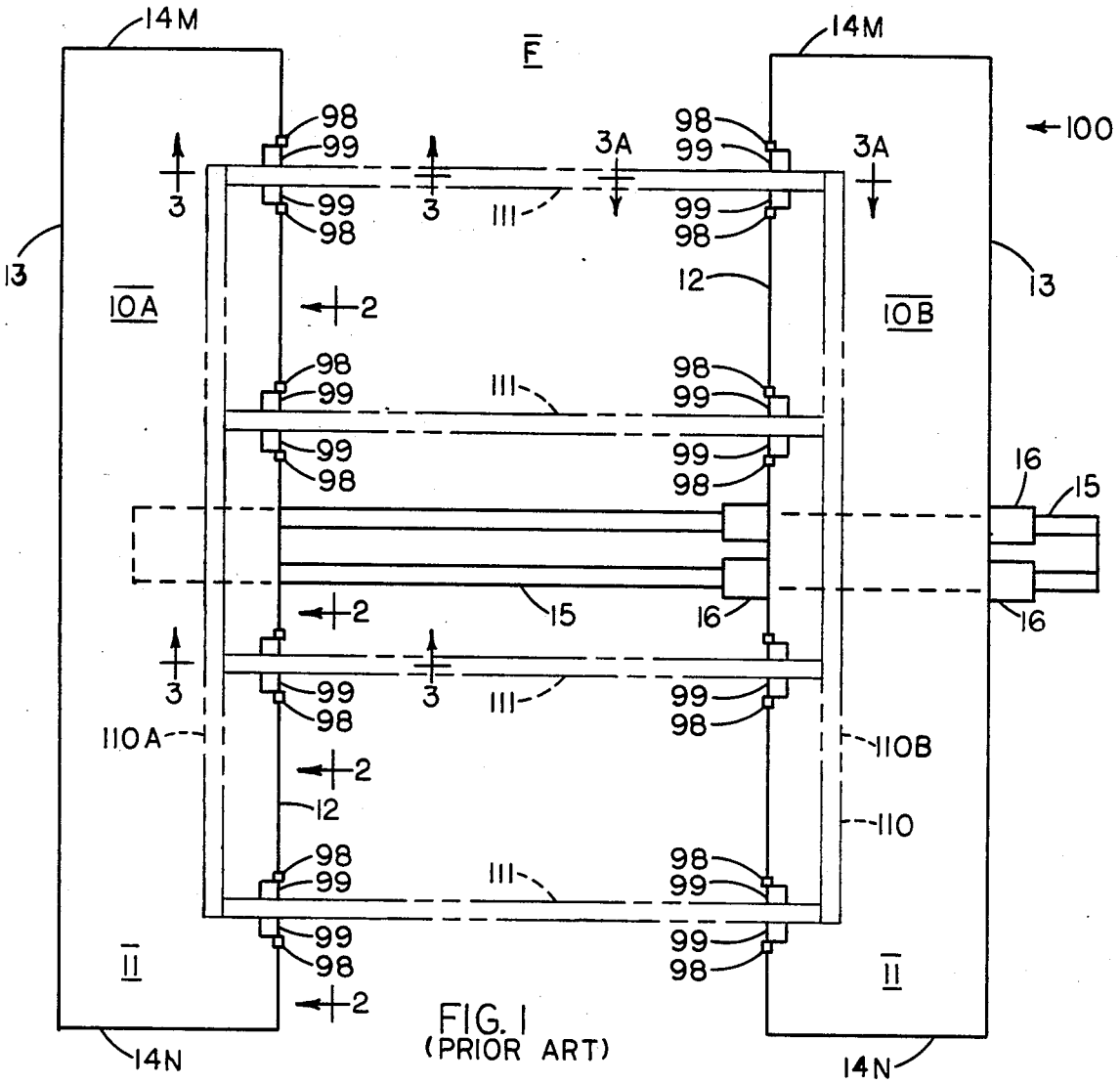
FIG. 1 (PRIOR ART)
FIGS. 1, 2 and 3, aforedescribed, are top plan, longitudinally extending sectional, and transversely extending views, respectively, of a framing table assembly (100) of the prior art.
Figure 2:
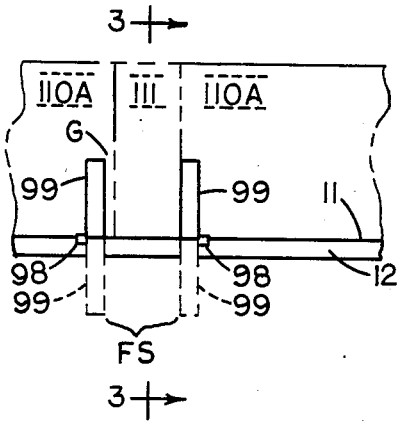
FIG. 2 (PRIOR ART)
Figure 3:
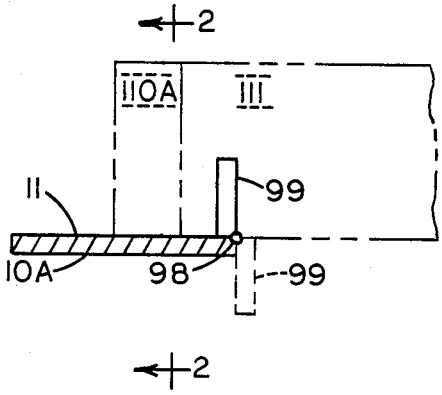
FIG. 3 (PRIOR ART)
Figure 4:
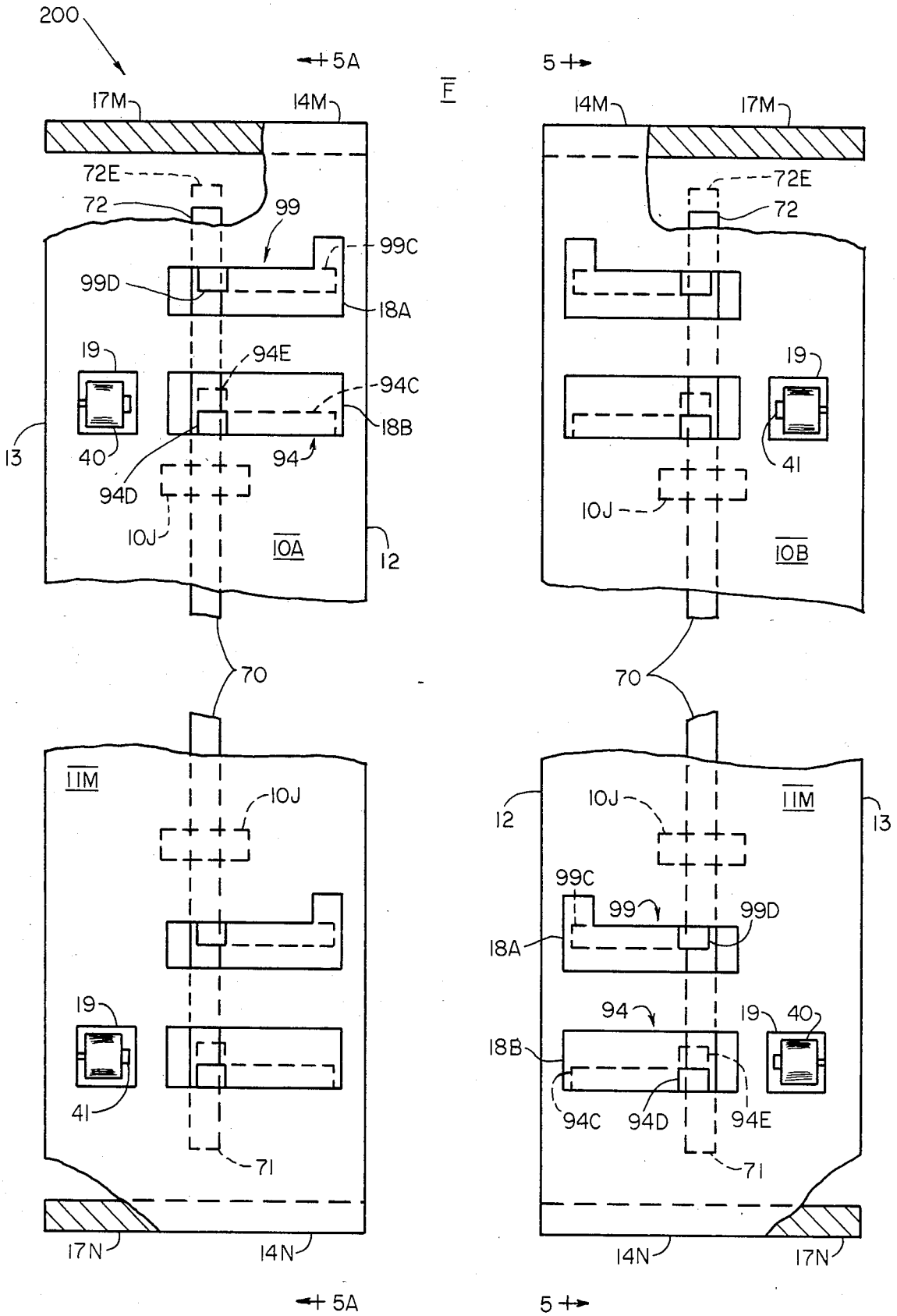
FIG. 4 is a top plan view of a representative embodiment (200) of the framing table assembly concept of the present invention.

FIG. 4, which is a top plan view of a representative embodiment 200 of the improved framing table concept of the present invention, retains from analagous FIG. 1 the pair of parallel rectangular benches 10A and 10B. Specifically retained for the embodiment 200 benches (10A and 10B) are, (i) the rectangular periphery defined by lineal edges 12, 13, 14M, and 14N;

(ii) the horizontally planar upper-surface 11M and the lower-surface 11N;

(iii) bench legs 17M and 17N and which maintain bench surfaces 11M and 11N above flooring F;

(iv) a transversely adjustable relationship between benches 10A and 10B (e.g. 15–16, or equivalent); and (v) for each teamed-flippers at upward ready-station, a fixed-spacing value FS. However, it will become apparent from the ensuing description that for each uprighted teamed-flippers, there is an additional upright station (i.e. an "active-station") wherein the inter-flippers spacing (e.g. 99D, 94E) is less than that for the ready-station fixed-spacing value FS. Such introduction of the flippers' active-station relegates the heretofore vexatious fixed-spacing FS to a relatively inconsequential operational parameter.

Figure 5:
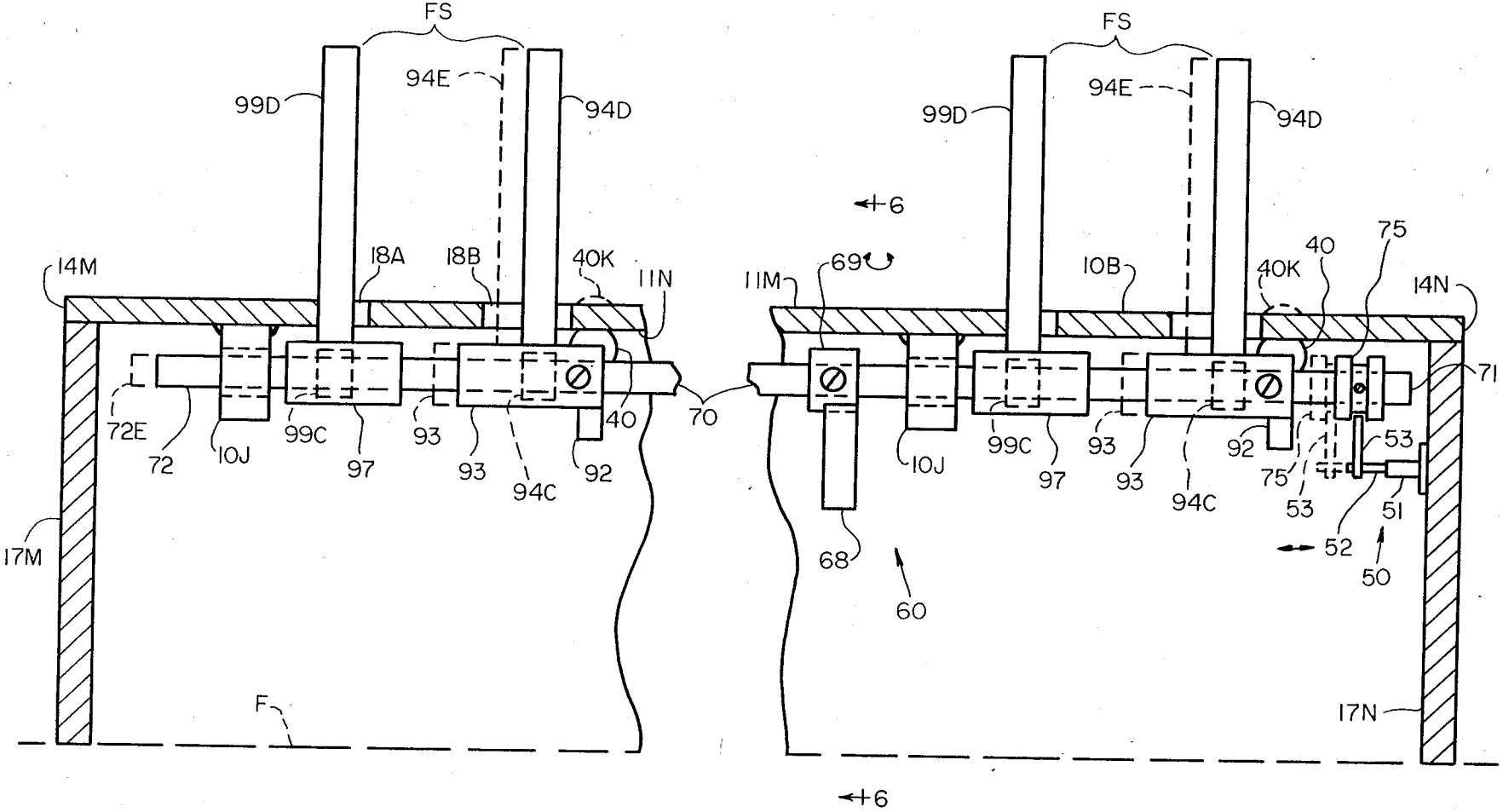
FIG. 5 is a longitudinally extending sectional elevational view taken along line 5—5 of FIG. 4.

It will be seen in FIGS. 4 and 5 that benches 10A and 10B are respectively provided with a longitudinally extending array of teamed-slots (e.g. slots 18A, 18B). Herein, each of the second-slots 18B is rectangular and has a longitudinally extending width exceeding the longitudinally extending width of the longer leg on each L-shaped first-slot 18A. FIG. 4 also shows a longitudinally extending array of apertures 19 located between the teamed-slots (18A, 18B) and the bench outward-edge 13; apertures 19 are in vertical registry with rollers 40 respectively provided with axles 41.

Underlying lower-surface 11N of each bench (10A, 10B), there is a longitudinally extending horizontal elongate shaft 70 having a trail-end 71 and a lead-end 72. For the purpose of rendering shaft 70 axially turnable and also longitudinally reciprocatable, said shaft is aptly supportable by longitudinally tubular hangers 10J that extend downwardly from benches' lower-surface 11N and that loosely surround said shaft 70. In vertical registry with each first-slot 18A, shaft 70 carries a surrounding first-collar 97 that is co-turnable with said shaft but that is not co-longitudinally constrained therewith. And in vertical registry with each second-slot 18B, shaft 70 carries a surrounding second-collar 93 that is co-turnable with shaft 70 and that is co-longitudinally constrained therewith as by the set-screw depicted in FIG. 5. For each first-collar 97, a first-flipper 99 is rigidly attached thereto, and for each second-collar 93, a second-flipper 94 is similarly rigidly attached thereto. Thus, at each teamed-slots (18A, 18B), there is a set of teamed-flippers (94, 99) respectively having an inactive-station (94C, 99C) located below bench upper-surface 11M and having a ready-station (94D, 99D) located above upper-surface 11M at said finite spacing FS. Teamed-flippers movement between downward inactive-station and upward ready-station, or vice versa, can be effected by manually lifting or depressing the flippers 94 and 99. Or alternatively, and as suggested by the double-headed curved arrows in FIGS. 5 and 6, there can be radial powering means (60) for axially turning shaft 70 in alternate angular directions. Such radial powering means 60 might comprise a crank-assembly (68, 69) co-turnably associated with shaft 70 and connected to a fluid-actuated reciprocatable plunger 62 that is pivotably attached (63) to crank-arm 68. Plunger 62 is reciprocatable within casing 61 carried by bench inward flange 12G.

Having now described the downward inactive-station (94C, 99C) and the upward ready-station (94D, 99D) for each set of teamed-flippers, the reader's attention is now called to the unique upright active-station (94E, 99D). In order to proceed from ready-station to the active-station and whereat the flippers' spacing (94E, 99D) has been reduced below finite-spacing value FS, it is necessary to longitudinally arrest one of the uprighted flippers (e.g. 99) but while longitudinally moving the other uprighted flipper (e.g. 94). In the former regard, each uprighted first-flipper (99D) and its said first-collar 93 can be longitudinally arrested by, for example, empirically minimizing the longitudinally directional width of first-slots 18A. And in the latter regard, there should be a generous longitudinally directional width for second-slots 18B so that each uprighted second-flipper and its second-collar (93) will be free to longitudinally co-reciprocate with shaft 70 and without physically striking bench structural material as piston 52 reciprocates.

There are longitudinally reciprocatable powering means (50) for longitudinally reciprocating elongate shaft 70 with respect to the slotted bench and hanger journals 10J. Thus, when shaft lead-end 72 is longitudinally shifted to condition 72E, co-reciprocatable second-collar 93 and uprighted second-flipper 94D will move toward said longitudinally arrestable first-collar 97 and uprighted first-flipper 99D and the resultant flippers' reduced-spacing is synonymous with the desired active-station (94E, 99D). Moreover, the same longitudinal powering means can also cause the teamed-flippers to return from active-station to ready-station whereupon the greater finite-spacing value FS is reattained. One such longitudinally reciprocatable powering means (50) comprises a fluid-operated horizontal plunger 52 carrying a vertical extension 53 constrained within a double-flanged adapter 75 that is longitudinally co-reciprocatable with shaft 70. As suggested by the double-headed lineal arrow in Figure 5, piston or plunger 52 is longitudinally reciprocatable within a casing 51 attached to bench leg 17N. Accordingly, as plunger 52 is made to periodically longitudinally move, plunger extension 53 causes shaft 70 and the second-collar 93 to longitudinally co-move whereby uprighted teamed-flippers will move from ready-station to active-station, and also vice versa.

In view of the foregoing provision of the unique third or active-station (94E, 99D) for respective teamed-flippers, the prior art becomes freed of comprimising choices regarding the fixed finite-spacing value FS between uprighted teamed-flippers. But rather, since it is only at the final active-station where the skeletal framework riser-members (111) are affirmatively grasped by teamed-flippers, the fixed finite-spacing value FS (and existing only at the transitory ready-station (94D, 99D)) becomes a high-tolerance value (i.e. tolerable to the extent that the ready-station need only loosely flank a riser-member 111).

A desireable, but entirely optional, feature of the framing table assembly concept of the present invention is the capability for utilizing rollers (e.g. 40) having two distinct elevations, including, (a) roller elevation wholly below bench upper-surface 11M when the teamed-flippers are at ready-station or at active-station whereby such downward rollers (40) do not interfere with the fabrication of skeletal framework (100); and (b) roller elevation extending at least partially above bench upper-surface 11M whenever the teamed-flippers are moved to the downward inactive-station (99C, 99C) whereby said upward rollers (40K) provide a means for rolling the completed skeletal framework (100) off the apparatus parallel benches (10A, 10B).

Figure 6:
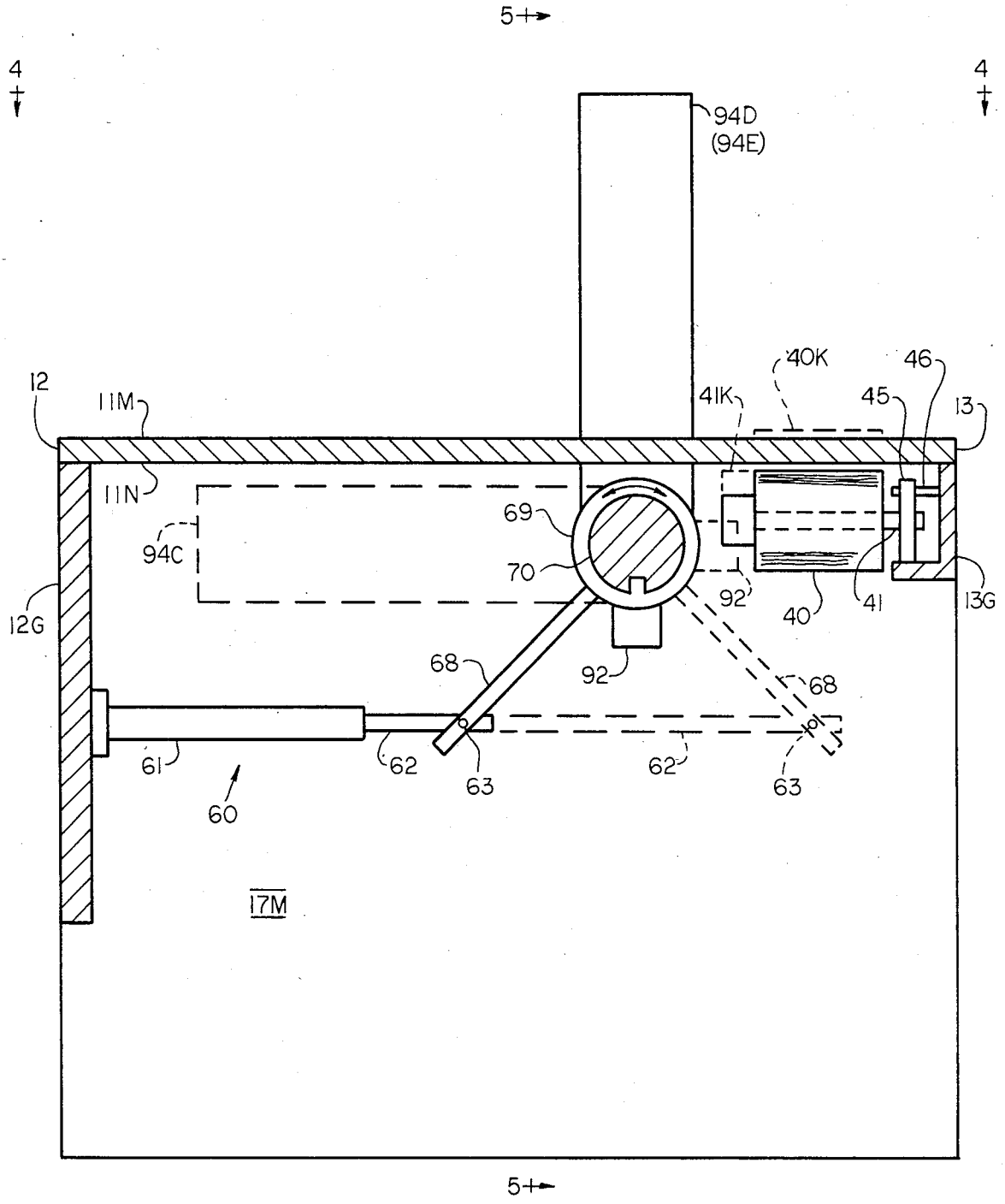
FIG. 6 is a transversely extending sectional elevational view of representative embodiment 200 and taken along line 6—6 of FIG. 5.

Such two distinct roller elevations might be effected by providing, for second-collars 93, a radial extension 92 that is diametrically opposed to second-flipper 94. Accordingly, as uprighted second-flipper (94D) is made to move downwardly to a horizontal inactive-station (94C), radial extension 92 coincidentally moves to a horizontal position whereby roller axle 41 is lifted to a higher elevation 41 K (phantom line of FIG. 6). Remote from shaft 70, the roller axle 41 is journalled by an eccentric member 45 that is pivotably attached (46) to bench outward flange 13G. In FIG. 6, solid lines indicate the positions of crank-arm 68, second-collar extension 92, and the depressed roller 40 whenever the flippers (e.g. 94, 99) are uprighted at ready-station; and phantom lines indicate the positions of crank-arm 68, second-collar extension 92, and the elevated roller (40K) whenever the teamed-flippers have assumed the downward inactive-station.

From the foregoing, the construction and operation of the framing table assembly concept of the present invention will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

What is claimed is as follows:

1. For use in manufacturing a skeletal framework comprising a plurality of parallel riser-members transversely perpendicularly intervening between parallel longitudinally extending base-members, a framing table assembly for precisely and securely positioning said riser-members and base-members horizontally whereby the riser-members might be accurately and perpendicularly attached to said base-members, and said framing table assembly comprising:

(A) a pair of parallel, longitudinally extending, and transversely separated benches and respectively having horizontal planar upper-surface and lower-surface and also having a longitudinally extending inward-edge confronting the other bench;

(B) each of said benches and directionally longitudinal therealong being provided with a plurality of teamed-flippers movably associated with said bench, each teamed-flippers pair having a downward inactive-station located below the bench upper-surface and also having an upward ready-station located above the bench upper-surface, and a directionally longitudinal finite-spacing existing between the two teamed-flippers at ready-station whereby they might loosely positionably flank a riser-member horizontally supported by said benches; and (C) controllably actuatable whenever teamed-flippers are at upward ready-station, finite-spacing reduction means for reducing said finite-spacing to a lesser reduced-spacing and thereby providing a teamed-flippers active-station wherein the positionably flanked riser-member might be securely held between the teamed-flippers, and said finite-spacing reduction means comprising: an elongate and longitudinally extending horizontal shaft having an underlying association with a said bench, said underlying association including capabilities for axially turning and for longitudinally reciprocating said shaft; for each teamed-flippers pair, a first-flipper carried by a longitudinally arrestable first-collar that is in co-turnably surrounding relationship with said shaft, and a second-flipper carried by a second-collar that is in co-turnably surrounding relationship and longitudinally co-reciprocatable with said longitudinal shaft; and longitudinal powering means for longitudinally reciprocating said shaft and said second-collar, whereby said co-reciprocatable second-collar can move toward said longitudinally arrestable first-collar and the resultant reduced-spacing therebetween is synonymous with said active-station, and whereby said longitudinal powering means can also cause the teamed-flippers to move from active-station to ready-station.

2. The framing table assembly of claim 1 wherein each of the benches has a substantially rectangular shape peripherally defined by a longitudinally extending inward-edge immediately facing the other bench, a longitudinally extending outward-edge, and two shorter transverse-edges.

3. The framing table assembly of claim 1 wherein each said longitudinal shaft is supported by hanger members attached to and extending below a bench, each said hanger member loosely surrounding a said longitudinal shaft; and wherein for each teamed-flippers pair, the first-flipper at inactive-station directly underlies a substantially rectangular first-slot opening of said bench and provides a selectable means for longitudinally arresting said first-collar at ready-station and at active-station, and the second-collar at inactive-station directly underlies a substantially rectangular and relatively wide second-slot opening of said bench and permits said second-collar at upward ready-station to effect said active-station.

4. The framing table assembly of claim 3 wherein each of said benches, and in a longitudinal direction therealong between said bench outward-edge and said longitudinally extending array of plural first-slots and second-slots, is provided with a longitudinally extending array of bench apertures, a roller located at each said aperture and having a lower-station and an upper-station, and there being means for moving each said roller from lower-station to upper-station whenever said teamed-flippers move from upward ready-station to downward inactive-station.

5. The framing table assembly of claim 2 wherein the longitudinally extending array of teamed-flippers is located nearer to the bench inward-edge than to the outward-edge.

6. The framing table assembly of claim 1 wherein there are radial powering means for axially turning said longitudinal shaft whereby said teamed-flippers can be powerably moved between said inactive and ready stations.

7. For use in manufacturing a skeletal framework comprising a plurality of parallel riser-members transversely perpendicularly intervening between parallel longitudinally extending base-members, a framing table assembly for precisely and securely positioning said riser-members and base-members horizontally whereby the riser-members might be accurately and perpendicularly attached to said base-members, and said framing table assembly comprising:

(A) a pair of parallel, longitudinally extending, transversely separated, and multi-apertured benches and respectively having horizontal planar upper-surface and lower-surface and also having longitudinally extending outward-edge and an inward-edge confronting the other bench;

(B) each of said benches and directionally longitudinal therealong being provided with an array of teamed-flippers movably associated with said bench, each teamed-flippers pair having a downward inactive-station located below the bench upper-surface and also having an upward ready-station located above the bench upper-surface; and (C) between the teamed-flippers array and the bench outward-edge, a longitudinally extending array of rollers that are respectively rotatable about a transverse-axis, each of said rollers having a lower-station and also having an upper-station extending above a bench aperture whereby a finally attached framework might be rolled directionally longitudinally off the parallel benches, and there being means for elevating each said roller from lower-station to upper-station whenever said teamed-flippers are moving from upward ready-station to downward inactive-station.

* * * * *